United States Patent [19]

Smolinski

[11] 4,212,603

[45] Jul. 15, 1980

[54] ROTARY VANE MACHINE WITH CAM FOLLOWER RETAINING MEANS

[76] Inventor: Ronald E. Smolinski, 4081 Forest Ridge Blvd., Dayton, Ohio 45424

[21] Appl. No.: 934,952

[22] Filed: Aug. 18, 1978

[51] Int. Cl.[2] ..... F01C 1/00; F03C 3/00; F04C 1/00; F04C 17/00

[52] U.S. Cl. ..... 418/256; 418/257; 418/264; 418/265

[58] Field of Search ..... 418/256, 257, 264, 265

[56] References Cited

U.S. PATENT DOCUMENTS

| | | | |
|---|---|---|---|
| 118,993 | 9/1871 | Wentworth | 418/265 |
| 870,290 | 11/1907 | Henkel | 418/265 |
| 1,952,142 | 3/1934 | Peterson | 418/265 |
| 2,672,282 | 3/1954 | Novas | 418/265 |
| 3,955,540 | 5/1976 | Blanchard | 418/256 |
| 3,988,083 | 10/1976 | Shimizu et al. | 418/264 |

FOREIGN PATENT DOCUMENTS

| | | | |
|---|---|---|---|
| 455476 | 2/1926 | Fed. Rep. of Germany | 418/265 |
| 458384 | 4/1928 | Fed. Rep. of Germany | 418/265 |
| 259346 | 10/1926 | United Kingdom | 418/256 |

*Primary Examiner*—John J. Vrablik
*Attorney, Agent, or Firm*—Biebel, French & Nauman

[57] ABSTRACT

A rotary machine includes a stator housing having an inner surface defining a stator chamber. The housing further defines inlet and outlet ports through the housing into the chamber. A substantially cylindrical rotor is rotatably mounted within the chamber for rotation about a rotor axis. A plurality of vanes are slidably received in the rotor and movable therewith about the rotor axis during rotation of the rotor, with tip portions of the vanes projecting outwardly toward the inner surface of the stator housing. A continuous, substantially cylindrical cam surface means defines a camming surface substantially concentric with the inner surface of the stator housing. A cam follower is mounted on each of the vanes contacting the substantially cylindrical cam surface. A cam follower retaining means is free to rotate with respect to the cam surface and defines a substantially cylindrical retaining surface which is concentric with the camming surface. The cam follower means thus positions the vanes during rotation of the rotor.

13 Claims, 9 Drawing Figures

ROTARY VANE MACHINE WITH CAM FOLLOWER RETAINING MEANS

BACKGROUND OF THE INVENTION

The present invention relates to rotary machines and, more particularly to rotary machines of the type used as pumps or compressors. In many such machines, a stator housing defining a stator chamber is provided in which is rotatably mounted a rotor. The rotor carries radially movable vanes which co-operate with the inner surface of the stator chamber to form discrete chambers which vary volumetricaly as the rotor, carrying the vanes, rotates within the stator. In machines of this type, the rotor will typically be mounted for rotation about an axis which is off-center with respect to the stator chamber in which it rotates. The rotor vanes are mounted on the rotor such that they may move radially with respect to the rotor to remain in contact with the surface of the stator chamber. Various arrangements have been used in the past in order to position the vanes properly with respect to the rotor such that the vanes will form the desired discrete chambers within the stator.

U.S. Pat. No. 3,955,540, issued May 11, 1976, to Blanchard discloses a rotary, internal combustion engine in which a rotor carrying vanes is rotatably mounted in a housing. The vanes are spring loaded to maintain their outer tips in sliding engagement with the inner surface of the housing and rollers on their inner ends in engagement with a vane race. With this construction, the vanes are pressed into engagement with the inside wall of the stator housing and necessarily there are substantial frictional energy losses as well as appreciable wear, not only of the vane tips, but also of the wall of the stator housing.

U.S. Pat. No. 3,988,083, issued Oct. 26, 1976, to Shimizu et al discloses a pump in which frictional engagement between the vane tips and the inside wall of the casing is eliminated by providing annular, outside races which are engaged by followers associated with the vanes. This arrangement limits the outward movement of the vanes into contact with the inner wall of the casing. Cylindrical springs inwardly of the followers urge the followers into contact with the races. As the pressure in each of the chambers defined by the vanes increases, the vanes may be lifted away from the inner surface of the casing, resulting in substantial leakage around the vanes and operating inefficiency of the pump.

U.S. Pat. No. 870,290, issued Nov. 5, 1907, to Henkel and U.S. Pat. No. 118,993, issued Sept. 12, 1871, to Wentworth, both disclose rotary machines having bearing followers which track through annular grooves in the interior of the stator housing. Since the interior and exterior surfaces of the annular grooves are fixed, however, it will be appreciated that substantial sliding must occur between the bearing followers and the groove surfaces during rotation of the rotors.

U.S. Pat. No. 2,672,282, issued Mar. 16, 1954, to Novas, discloses a rotary device in which the rotor vanes are positioned by blocks moving in an annular channel in the stator housing. A ball bearing race in the annular channel facilitates movement of the blocks. This configuration may be subject to substantial vibration as extensions of the vanes strike the blocks during rotation.

In U.S. Pat. No. 4,133,618, issued Jan. 9, 1979 to Ronald E. Smolinski, rotary machine is disclosed in which radial movement of the vanes is accomplished by means of cam followers which are attached to the vanes and which ride on stationary cam surfaces. Tension springs draw the vanes radially inward of the rotor so that the cam followers are held in contact with the cam surfaces. Such an arrangement may require springs which are manufactured to precise tolerances, however.

Accordingly, it is seen that there is a need for an improved rotary machine in which positive positioning of the rotor vanes is accomplished with minimal friction by the vane positioning structure.

SUMMARY OF THE INVENTION

A rotary machine includes a stator housing having a substantially cylindrical, inner surface, defining a stator chamber, said housing further defining inlet and outlet ports through said housing into said chamber. A substantially cylindrical rotor is rotatably mounted within the chamber for rotation about a rotor axis. A plurality of vanes are slidably received in the rotor and movable therewith about the rotor axis during rotation of the rotor, with tip portions of the vanes projecting outwardly toward the inner surface of the stator housing. A continuous, substantially cylindrical, cam surface means defines a camming surface substantially concentric with the inner surface of the stator housing. A cam follower means is mounted on each of the vanes contacting the substantially cylindrical surface. A cam follower retaining means is provided which is free to rotate with respect to the cam surface means. The cam follower retaining means defines a substantially cylindrical retaining surface concentric with the cam surface. The cam follower retaining means urges the cam follower means against the cam surface means, whereby the cam follower means position the vanes during rotation of the rotor.

The cam follower means may each comprise a rolling element bearing mounted on a respective vane and having an outer bearing race held in contact with the camming surface by the retaining means. The camming surface may be outwardly facing and fixed with respect to the stator housing. The cam follower retaining means comprises a retaining race defining an inner retaining surface for contacting the outer race of each of the rolling element bearings.

Alternately, the camming surface may be inwardly facing and fixed with respect to the stator housing with the cam follower retaining means comprising a retaining race defining an outer retaining surface for contacting the outer race of each of the rolling element bearings.

As a further alternative, the cam surface means may be rotatable with respect to the stator housing and may comprise a rolling element bearing rotatable with respect to the stator housing, with an outer race defining an outwardly facing camming surface. The cam follower retaining means comprises a retaining race defining an inner retaining surface for contacting each of the cam follower means whereby the cam follower means are urged inwardly into contact with the camming surface.

Accordingly, it is an object of the present invention to provide a rotary machine, having rotor vanes which are radially movable with respect to a rotor, in which an arrangement for positively positioning each of the vanes during rotation of the rotor is provided; to provide such a rotary machine in which cam followers are mounted on each of the vanes in contact with a camming surface; and to provide such a rotary machine in which a cam follower retainer is free to rotate with respect to the camming surface and urges the cam follower against the camming surface.

DESCRIPTION OF THE PREFERRED EMBODIMENTS

Figure 1:
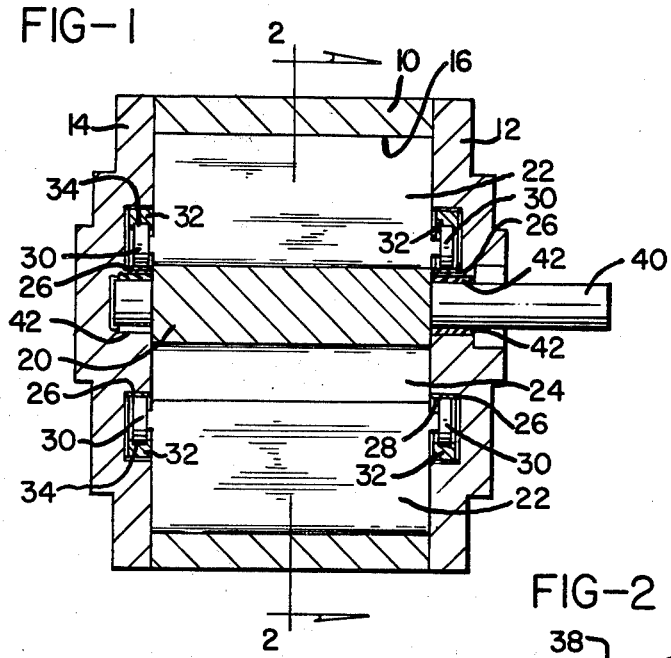
FIG. 1 is a sectional view of a rotary machine of the present invention, taken generally along the axis of rotation of the rotor.
Figure 2:
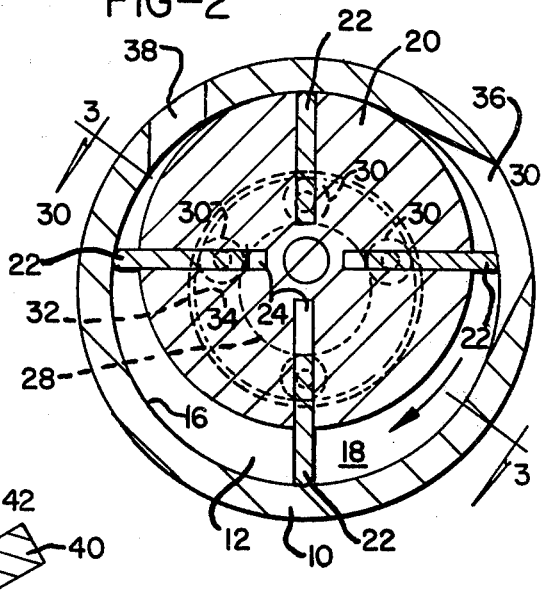
FIG. 2 is a sectional view of the rotary machine of FIG. 1, taken generally along line 2—2 in FIG. 1.
Figure 3:
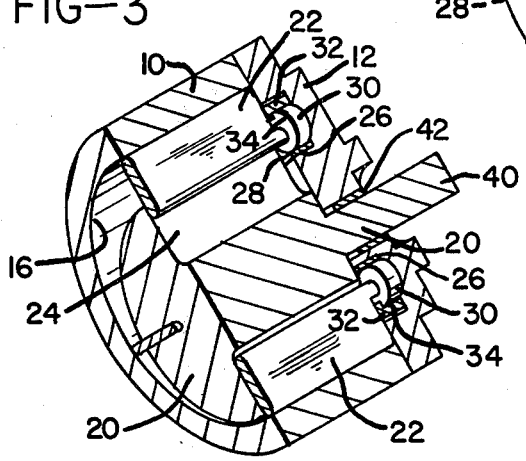
FIG. 3 is a fragmentary perspective of the rotary machine of FIGS. 1 and 2, sectioned generally along line 3—3 in FIG. 2.

Reference is now made to FIGS. 1–3, illustrating one embodiment of the present invention. A stator housing, including an annular housing shell 10 and housing end plates 12 and 14, has an inner surface 16 defining a stator chamber 18. Surface 16 may be substantially cylindrical in some machines, while in other machines it may be slightly oval in shape. Plates 12 and 14 may be fastened to the shell 10 by means of bolts (not shown). A substantially cylindrical rotor 20 is rotatably mounted within the chamber 18 for rotation about a rotor axis.

A plurality of vanes 22 are slidably received in slots 24 in the rotor 20 and movable therewith about the rotor axis during rotation of the rotor 20. The tip portions of vanes 22 project outwardly toward the inner surface 16 of the stator housing. A continuous, substantially cylindrical cam surface means includes a hardened ring 26 at each end of the rotor, defining a camming surface 28 which is substantially concentric with the inner surface 16 of the stator housing. Cam follower means, including rolling element bearings 30 are mounted on each of the vanes 22, contacting the substantially cylindrical cam surfaces 28. Bearings 30 may comprise roller bearings or ball bearings with each such bearing having an outer bearing race in contact with the camming surfaces 28. A cam follower retaining means, including retaining races 32, is free to rotate with respect to the cam surface means defining camming surfaces 28. The cam follower retaining means defines substantially cylindrical retaining surfaces 34 which are concentric with the camming surfaces 28. Surfaces 34 are inner retaining surfaces which contact the outer race of each of the rolling element bearings 30 and urge the bearings 30 inwardly into contact with the camming surfaces 28.

As seen in FIG. 2, the stator housing defines an inlet port 36 and an outlet port 38. As the rotor 20 is rotated by a motor, or other prime mover attached to rotor shaft 40, the fluid taken into the chamber 18 through the inlet port 36 will be gradually compressed as it is moved by the vanes 22 toward the outlet port 38. It will be appreciated that although the instant invention is described in the context of a compressor, the invention will have utility with any type of rotary machine having vanes which are radially movable with respect to a rotor.

For the purposes of illustration, the rotor 20 is shown mounted within a stator housing by means of sleeve bearings 42. Such bearings will permit free rotation of the rotor 20, while maintaining the required seal around the rotor shaft 40. It should be understood, however, that the present invention is in no way limited to a specific rotor bearing structure and that the rotor may alternatively be mounted in ball bearings, roller bearings, or any other suitable bearing configuration with appropriate seals provided to ensure that the fluid in the stator chamber does not escape around the rotor shaft 40.

In operation, it will be appreciated that since the camming surface 28 is substantially concentric with the inner surface 16 of the stator chamber, the cam follower means including rolling element bearings 30 will positively position the vanes 22 such that the tips of the vanes remain in effective contact with the surface 16 during rotation of the rotor 20. Each of the vanes will be properly positioned along its entire length with respect to the inner surface 16 of the stator chamber 18 by the camming surface 28, cam follower means, and cam follower retaining means at each end of the vanes 22.

Since the retaining race 32 is free to rotate in the stator housing, very little slippage will result between the race 32, the rolling element bearings 30, and the camming surface 28, with the result that sliding friction in the cam follower arrangements of the present invention will be negligible.

Figure 4:
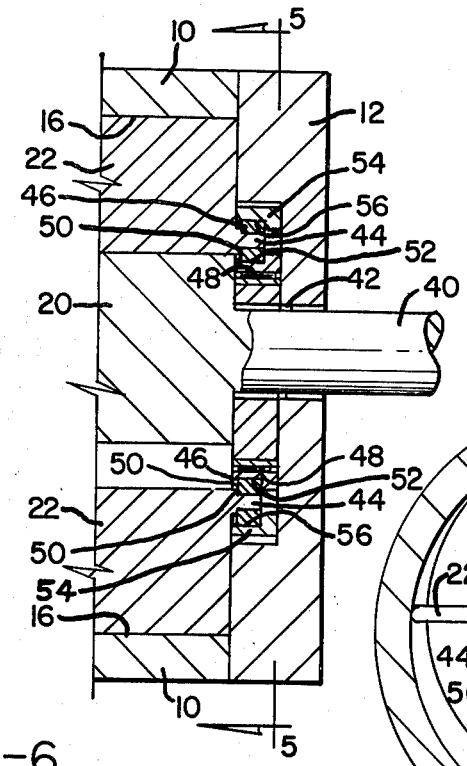
FIG. 4 is a partial sectional view of an alternative embodiment of the present invention, taken generally along the rotational axis of the rotor.
Figure 5:
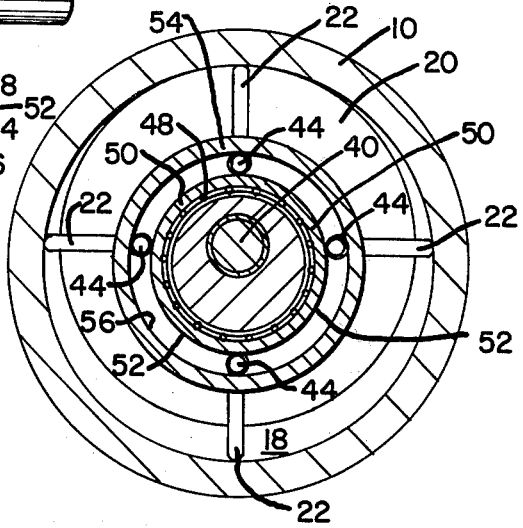
FIG. 5 is a sectional view taken generally along line 5—5 in FIG. 4 with the end plate of the machine removed.

Reference is now made to FIGS. 4 and 5 which illustrate an alternative embodiment of the present invention. FIG. 4 is a sectional view taken along the axis of rotation of the rotor, similar to FIG. 1, but with only half of the rotary machine illustrated. It will be appreciated that the vane positioning arrangement illustrated in FIG. 4 as being at one end of the vanes is duplicated at the opposite end of the vanes. The embodiment of FIGS. 4 and 5 is similar in some respect to that of FIGS. 1–3 and, accordingly, the same reference numerals have been used to identify elements which do not differ substantially between the two embodiments. Vanes 22 each have a cylindrical extension 44, including a bushing 46 of hardened metal, extending laterally therefrom. The cam surface means is rotatable with respect to the stator housing and includes a rolling element bearing 48, which is shown for the sake of illustration as a needle bearing. Bearing 48 has an outer race 50 which defines outwardly facing camming surface 52.

The cam follower retaining means comprises a retaining race 54 defining an inner retaining surface 56 which contacts each of the cam follower means. The cam follower means are urged inwardly into contact with the camming surface 52 by the retaining race 54. Since the retaining race 54 and the rolling element bearing 50 are both free to rotate with respect to the stator housing as the rotor 20 is rotated in chamber 18, it will be appreciated that there will be relatively little sliding friction between the vane extensions 44, the race 54 and the camming surface 52. Grooves may be formed in the surface 52 and 56, as shown, to prevent axial movement of vanes 22.

Figure 6:
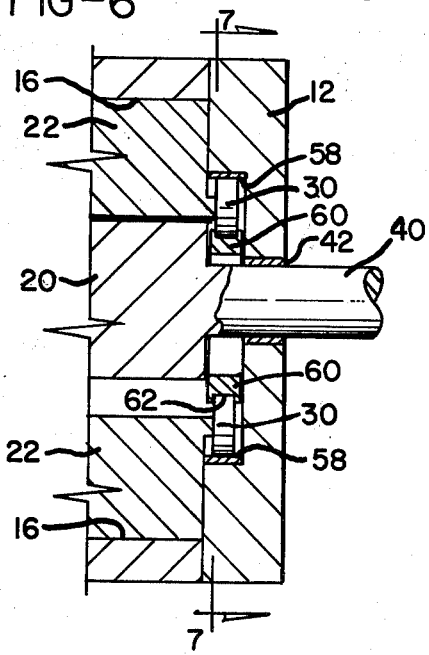
FIG. 6 is a partial sectional view, similar to FIG. 4, of a further embodiment of the present invention.
Figure 7:
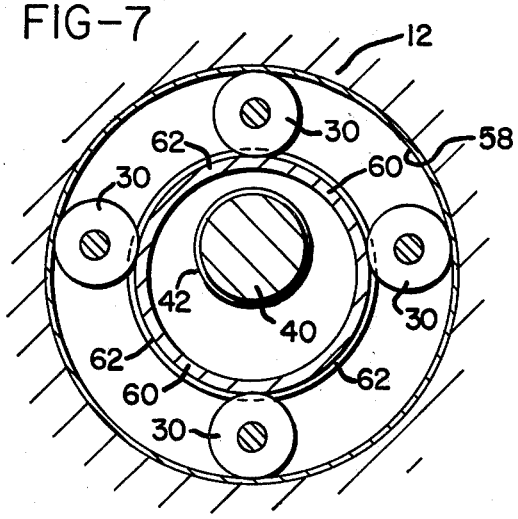
FIG. 7 is a sectional view taken generally along line 7—7 in FIG. 6.

Reference is now made to FIGS. 6 and 7, which illustrate a further embodiment of the present invention. Many of the elements of the embodiment of FIGS. 6 and 7 are similar to those of the embodiment of FIGS. 1–3 and, therefore, have been identified with the same reference numerals. FIG. 6 is a view similar to that of FIG. 4, showing only half of the rotary machine of the present invention. It will be appreciated that the embodiment of FIGS. 6 and 7 will have identical camming structure at each end of the vanes 22. THe cam follower means each comprise a rolling element bearing 30 which is mounted on a respective vane 22. A camming surface 58 is provided which is inwardly facing and fixed with respect to the stator housing. The cam follower retaining means comprises a retaining race 60 which defines an outer retaining surface 62. Retaining surface 62 contacts the outer race of each of the rolling element bearings 30 and urges the bearings 30 outwardly into contact with the camming surface 58. Since the camming surface 58 is concentric with the inner surface 16 defined by the stator housing, the vanes 22 will be appropriately positioned during rotation of the rotor 20 such that they will remain in effective engagement with the surface 16 of the stator housing. It will be further appreciated that since the retaining race 60 is free to rotate in the housing, very little sliding friction will result between the bearings 30 and the surfaces 58 and 62.

Figure 8:
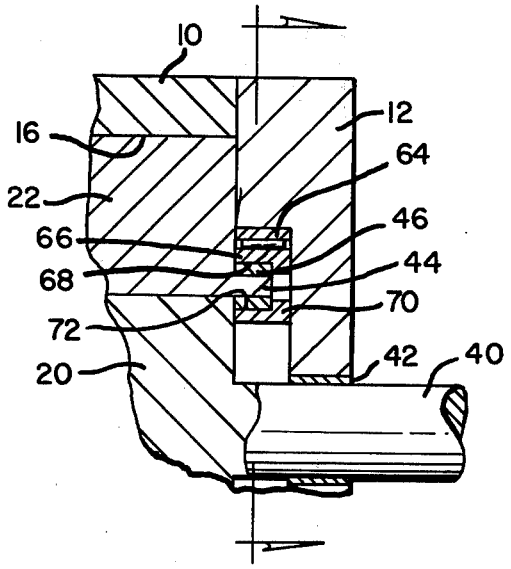
FIG. 8 is a partial sectional view of a further embodiment of the present invention, taken generally along the rotational axis of the rotor.
Figure 9:
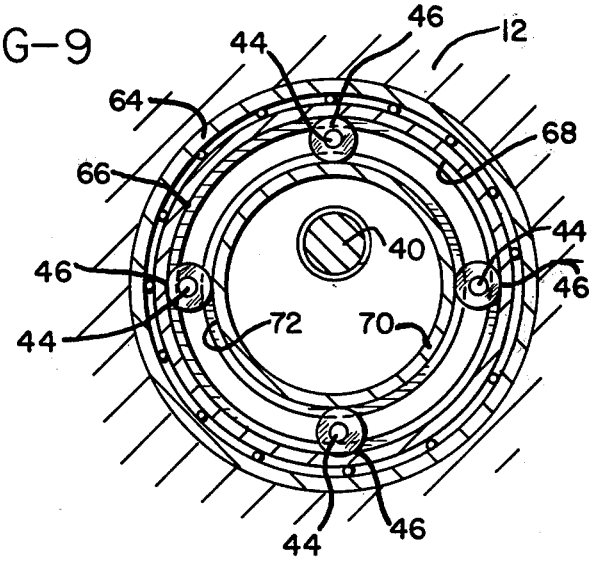
FIG. 9 is a sectional view taken generally along line 9—9 in FIG. 8.

Reference is now made to FIGS. 8 and 9 which illustrate a further alternative embodiment of the present invention. FIG. 8 is a sectional view taken generally along the axis of rotation of the rotor, similar to FIG. 1, but with only a portion of the rotary machine illustrated. It will be appreciated that the vane positioning arrangement illustrated in FIGS. 4 and 5 is duplicated at the opposite end of the machine. The embodiment of FIGS. 8 and 9 is similar in some respects to that of FIGS. 4 and 5 and, accordingly, the same reference numerals have been used to identify elements which do not differ substantially between the two embodiments. Vanes 22 each have a cylindrical extension 44, including a bushing 46 of hardened metal, extending laterally therefrom. The cam surface means is rotatable with respect to the stator housing and includes a rolling element bearing 64 which is shown for the sake of illustration as a needle bearing. Bearing 64 has an inner race 66 which defines an inwardly facing camming surface 68.

The cam follower retaining means comprises a retaining race 70 defining an outer retaining surface 72 which contacts each of the cam follower means. The cam follower means are urged outwardly into contact with the camming surface 68 by the retaining race 70. Since the retaining race 70 and the rolling element bearing 64 are both free to rotate with respect to the stator housing as the rotor 20 is rotated in chamber 18, it will be appreciated that there will be relatively little sliding friction between the vane extensions 44, the race 70, and the camming surface 68. Grooves may be formed in the surfaces 68 and 70, as shown, to prevent axial movement of vanes 22.

While the forms of apparatus herein described constitute preferred embodiments of the invention, it is to be understood that the invention is not limited to these precise forms of apparatus, and that changes may be made therein without departing from the scope of the invention.

What is claimed is:

1. A rotary machine comprising:

a stator housing having an inner surface defining a stator chamber, said housing further defining inlet and outlet ports through said housing into said chamber, a substantially cylindrical rotor rotatably mounted within said chamber for rotation about a rotor axis, a plurality of vanes slidably received in said rotor and movable therewith about said rotor axis during rotation of said rotor with tip portions of said vanes projecting outwardly toward said inner surface of said stator housing, continuous, substantially cylindrical, cam surface means defining a camming surface substantially concentric with said inner surface of said stator housing, cam follower means mounted on each of said vanes contacting said substantially cylindrical camming surface, and cam follower retaining means being free to rotate with respect to said cam surface means, defining a substantially cylindrical retaining surface concentric with said camming surface, said substantially cylindrical retaining surface being defined within a groove on said cam follower retaining means, said retaining means engaging said cam follower means within said groove and urging said cam follower means against said cam surface means, whereby said cam follower means position said vanes during rotation of said rotor and relative axial movement between said cam follower retaining means and said vanes is prevented.

2. The rotary machine of claim 1 in which said cam follower means each comprises a rolling element bearing mounted on a respective vane and having an outer bearing race held in contact with said camming surface by said retaining means, each of said rolling element bearings being engaged by said groove and contacting said substantially cylindrical retaining surface.

3. The rotary machine of claim 2 in which said camming surface is outwardly facing and fixed with respect to said stator housing.

4. The rotary machine of claim 3 in which said cam follower retaining means comprises a retaining race defining an inner retaining surface for contacting the outer race of each of said rolling element bearings whereby said rolling element bearings are urged inwardly into contact with said camming surface.

5. The rotary machine of claim 2 in which said camming surface is inwardly facing and fixed with respect to said stator housing.

6. The rotary machine of claim 5 in which said cam follower retaining means comprises a retaining race defining an outer retaining surface for contacting the outer race of each of said rolling element bearings whereby said rolling element bearings are urged outwardly into contact with said camming surface.

7. The rotary machine of claim 1 in which said cam surface means is rotatable with respect to said stator housing.

8. The rotary machine of claim 7 in which said cam surface means comprises a rolling element bearing rotatable with respect to said stator housing and having an outer race defining an outwardly facing camming surface.

9. The rotary machine of claim 8 in which said cam follower retaining means comprises a retaining race defining an inner retaining surface for contacting each of said cam follower means, whereby said cam follower means are urged inwardly into contact with said camming surface.

10. The rotary machine of claim 9 in which said cam follower means each comprises a cam follower slidably contacting said outwardly facing camming surface and said inner retaining surface.

11. The rotary machine of claim 7 in which said cam surface means comprises a rolling element bearing rotatable with respect to said stator housing and having an inner race defining an inwardly facing camming surface.

12. The rotary machine of claim 11 in which said cam follower means comprises a retaining race defining an outer retaining surface for contacting each of said cam follower means, whereby said cam follower means are urged outwardly into contact with said camming surface.

13. The rotary machine of claim 12 in which said cam follower means each comprises a cam follower slidably contacting said inwardly facing camming surface and said outer retaining surface.

* * * * *